United States Patent [19]

Kortmann et al.

[11] Patent Number: 4,781,844

[45] Date of Patent: Nov. 1, 1988

[54] FLUORINE CONTAINING SILICONE TEXTILE-FINISHING AGENT: SILICONE SUSPENSION AND PERFLUOROALKYL POLYMER

[75] Inventors: Wilfried Kortmann, Hagen; Helmut Steinberger; Josef Pfeiffer, both of Leverkusen; Ulrich Koemm, Cologne, all of Fed. Rep. of Germany

[73] Assignee: Bayer Aktiengesellschaft, Leverkusen, Fed. Rep. of Germany

[21] Appl. No.: 53,168

[22] Filed: May 21, 1987

Related U.S. Application Data

[63] Continuation of Ser. No. 904,071, Sep. 4, 1986, abandoned, which is a continuation of Ser. No. 801,722, Nov. 26, 1985, abandoned, which is a continuation of Ser. No. 580,311, Feb. 15, 1984, abandoned.

[30] Foreign Application Priority Data

Mar. 3, 1983 [DE] Fed. Rep. of Germany ..... 3307420

[51] Int. Cl.[4] ..... D06M 15/66; C08L 83/04

[52] U.S. Cl. ..... 252/8.6; 8/115.64; 8/181; 8/194; 8/196; 252/8.57; 252/8.7; 252/8.75

[58] Field of Search ..... 252/8.6, 8.7, 8.75

[56] References Cited

U.S. PATENT DOCUMENTS

| | | | |
|---|---|---|---|
| 3,083,224 | 3/1963 | Brace et al. . | |
| 3,385,812 | 5/1968 | Brachman | 524/144 |
| 3,493,424 | 2/1970 | Mohrlok et al. | 428/87 |
| 3,949,136 | 4/1976 | Deiner et al. | 525/479 |
| 4,321,403 | 3/1982 | Oxenrider et al. | 252/8.9 |
| 4,351,736 | 9/1982 | Steinberger et al. | 252/8.6 |
| 4,473,371 | 9/1984 | Schinzel et al. | 8/115.62 |

FOREIGN PATENT DOCUMENTS

| | | |
|---|---|---|
| 66/11242 | 3/1968 | Australia . |
| 53-081799 | 7/1978 | Japan . |
| 1135757 | 12/1968 | United Kingdom . |
| 1155741 | 6/1969 | United Kingdom . |

*Primary Examiner*—A. Lionel Clingman

*Attorney, Agent, or Firm*—Sprung Horn Kramer & Woods

[57] ABSTRACT

A textile finishing agent comprising, by weight, about (A) 50–80 parts of an aqueous colloidal suspension, in the form of a sol, at least one of an organosilsesequioxane having units of the formula $RSiO_{3/2}$ (wherein R is optionally substituted alkyl or aryl of up to 7 carbon atoms) and a cocondensate of a hydrolyzate of a tetraalkoxysilane with an organotrialkoxysilane having $RSiO_{3/2}$ or $SiO_2$ units, and (B) 20–50 parts of an aqueous dispersion which contains about 5 to 50% by weight of an organic polymer resin which contains perfluoroalkyl groups which have 3 to 20 C atoms and which, in addition to fluorine atoms, can contain at most 1 hydrogen atom or chlorine atom per 2 C atoms and in which the perfluoroalkyl chain can be interrupted by oxygen and which has a fluorine content of about 0.2 to 40% by weight.

Textiles finished therewith are hydrophilic, oleophilic and soil resistant.

10 Claims, No Drawings

FLUORINE CONTAINING SILICONE TEXTILE-FINISHING AGENT: SILICONE SUSPENSION AND PERFLUOROALKYL POLYMER

This is a continuation of application Ser. No. 904,071, filed Sept. 4, 1986, now abandoned, which in turn is a continuation of application Ser. No. 801,722, filed Nov. 26, 1985, now abandoned, which in turn is a continuation of application Ser. No. 580,311, filed Feb. 15, 1984, now abandoned.

The present invention relates to a textile-finishing agent with which textile fibers can be finished to be soil-, oil- and water-repellent.

The consumer expects modern textile materials which are used as, for example, furniture-covering fabrics or as textile floor-coverings to have favorable properties in respect of their ability to withstand mechanical stress, i.e. static and dynamic loads, and to be impervious to water, oil and/or soil.

Textiles with a three-dimensional structure, for example pile materials which have a certain surface texture in the form of loops or cut loops (=velour) and are exposed to severe stress and strain during use are difficult to keep clean for long.

To keep clean for any length of time, any soiling which has arisen has, of necessity, to be easily removable to such an extent that only slight residues, if any, remain behind on the mateiral and do not impair the material optically at all or only insignificantly.

Soil substances can have, for example, the following composition and consistency: oil and oil-containing substances, liquid, aqueous stained substances, inorganic dry pigmentous substances (street dust), aqueous suspensions thereof and mixtures of said substances.

The principle of a protective finish is that the finishing agent provides the pile materials with hydrophobic and oleophobic properties which prevent liquid soil from sinking in. Dry soil does not adhere to the fibers and can be easily removed from, and out of, the pile material by, for example, vacuum-cleaning.

Processes have already been described elsewhere for treating fiber materials such as threads, fibers, fabrics and carpet (for example German Auslegeschrift No. 1,594,985) to provide these materials with non-slip properties and resistance to dry soil. These processes make use of colloidal suspensions of silsesquioxanes of units of the formula $RSiO_{3/2}$ with a particle size of 10 to 1,000 Angstrom.

The silsesquioxane suspensions described there, however, are relatively unstable and are not universally suitable for soil-repellent and pile-stabilizing finishing.

German Auslegeschrift No. 1,285,978 discloses a process for making textile materials oil- and water-repellent and reducing their absorption of dry soil. These effects are obtained by applying perfluoroalkyl-containing substances to the materials to be protected.

However, the finish with silsesquioxanes, on the one hand, and with perfluoroalkyl-containing substances, on the other, still left something to be desired, and since then the situation has not changed. It is true that attempts have already been made to finish textiles with silicofluorine chemicals (cf. for example TextilPraxis Int., 1972, August issue, page 503, or German Offenlegungsschrift No. 2,361,976), but it had to be recognized that, although the hydrophobic effect is much enhanced, the oleophobic effect of the fluorine chemical is completely lost. This is probably the reason why no such combination could be employed up to the present day.

However, it has been found, surprisingly, that combinations of certain organosilicate compounds with certain perfluoro compounds are highly suitable for use as textile-finishing agents and can thus be used to provide the fiber with universal protection.

Accordingly, the present invention relates to textile-finishing agents which are characterized in that they contain (A) 50–80 parts by weight of an aqueous colloidal suspension, in the form of a sol, or organosilsesquioxanes of units of the formula $RSiO_{3/2}$ (R=optionally substituted alkyl or aryl of up to 7 carbon atoms) and/or of cocondensates of hydrolyzates of tetraalkoxysilanes with organotrialkoxysilanes having $RSiO_{3/2}$ or $SiO_2$ units, and (B) 20–50 parts by weight of an aqueous dispersion which contains 5 to 50% by weight of an organic polymer resin which contains perfluoroalkyl groups which have 3 to 20 C atoms, which, in addition to fluorine atoms, can contain at most 1 hydrogen atom or chlorine atom per 2 C atoms and in which the perfluoroalkyl chain can be interrupted by oxygen and which has a fluorine content of 0.2 to 40% by weight.

Component (A) can be organosilsesquioxanes of the type described in, for example, German Auslegeschrift No. 1,594,985 or in German Offenlegungsschrift No. 3,004,824. These organosilsesquioxanes are prepared by adding, for example, silanes of the general formula R-Si $(OR')_3$ alone or together with $(Si(OR')_4)$ silanes wherein R denotes a substituted or unsubstituted hydrocarbon radical which has 1 to 7 carbon atoms, whose substituents can be halogen atoms or amino, mercapto and epoxy groups and which is up to 95% methyl, and R' denotes an alkyl radical of 1 to 4 carbon atoms, to a mixture of water, a buffer substance, a surfactant and, if appropriate, an organic solvent, under agitation and under acid or basic conditions.

To obtain a very narrow particle size distribution and a small average particle size of about 200 to 500 Angstrom, as are necessary for obtaining satisfactory pile-stabilizing and soil-repellent effects, it is necessary to add the silane in a uniform and slow manner. The exact amount of silane which can be added depends on the R substituent and on whether an anionic or cationic surfactant is used.

The simultaneous hydrolysis of the silanes produces silsesquioxane copolymers wherein the units can be in block form or randomly distributed. The amount in which silanes of the general formula $Si(OR')_4$ is preferably added is 2 to 50% of the total amount of the silanes used, preferably 3 to 20% (% by weight).

The silsesquioxane dispersion has roughly the following composition:

0.001 to 3% of surfactant
0.005 to 4% of buffer substance
5 to 22% of silane mixture
95 to 71% of water (%=% by weight)

where the dispersion contains about 2 to 9% by weight of silsesquioxanes and about 0.1 to 0.4% by weight of $SiO_2$ units.

The surfactants mentioned have the function of stabilizing the particles of the colloidal suspension which have formed.

The following silanes are preferably used: methyltrimethoxysilane, methyltriethoxysilane, methyltriisopropoxysilane, ethyltrimethoxysilane, ethyltriethoxysilane, propyltrimethoxysilane, isobutyltrimethoxysilane, isobutyltriethoxysilane, 2-ethylbutyltriethoxysilane, tetraethoxysilane and 2-ethylbutoxytriethoxysilane.

The anionic surfactants can be aliphatic and/or aromatic sulphonic acids, for example decylsulphonic, dodecylsulphonic, cetylsulphonic, stearylsulphonic, myristylsulphonic or oleylsulphonic acid or alkali metal salts thereof. If cationic surfactants are used, it is advantageous to use halides and, in particular, chlorides and bromides. Other surfactants, including those of the nonionic and amphoteric type, can be used together with the abovementioned surfactants, provided they have no adverse effect on the stability of the colloidal suspension, either due to their nature or their amount.

The surfactants are used in an amount of about 0.01 to about 15%, relative to the amount of silane used.

The process for preparing a colloidal suspension can be carried out at temperatures between room temperature and 80° C.; the temperature range between 50° and 70° C. is particularly preferred.

The perfluoroalkyl-containing compounds can be aqueous dispersions of a fluorocarbon resin.

The chemically bonded fluorine is in the form of perfluoroalkyl radicals having a chain length of 3 to 20 C atoms and can contain, in addition to fluorine atoms, at most one hydrogen or chlorine atom per 2 carbon atoms. The perfluoroalkyl chain can also be interrupted by oxygen atoms. The perfluoroalkyl radicals is bonded to a water-insoluble monomeric or polymeric organic compound. Examples which can be mentioned of compounds of this type are polyacrylates containing perfluoroalkyl radicals, (cf. for example German Auslegeschrift No. 1,595,017, German Auslegeschrift No. 1,595,018, German Offenlegungsschrift No. 2,939,549, German Auslegeschrift No. 2,134,978, German Auslegeschrift No. 2,660,200, German Auslegeschrift No. 1,106,960 and German Auslegeschrift No. 1,745,089), urethanes and polyurethanes containing perfluoroalkyl radicals, (cf. for example, German Offenlegungsschrift No. 1,468,295, German Auslegeschrift No. 1,794,356, German Patent No. 2,702,305, German Auslegeschrift No. 1,795,261 and German Offenlegungsschrift No. 1,956,198), and such esters of aromatic and aliphatic dicarboxylic and polycarboxylic acids as contain perfluoroalkyl radicals (cf. for example German Offenlegungsschrift No. 3,002,369, European Patent No. 19,732, German Offenlegungsschrift No. 3,119,071 and German Offenlegungsschrift No. 2,015,332).

The perfluoroalkyl-containing dispersion contains about 5 to 50% by weight of fluorocarbon resin having a fluorine content of 0.2 to 40, preferably 1.0 to 20, % by weight.

The aqueous dispersions of the fluorocarbon resins can, in addition, contain polymers or polycondensates which augment the film-forming or water-repellent properties of the perfluoro resin (see also Sherman, Smith, Johannessen, Text Res. J. 39 (1969) 449; Tomasino, Leastrunk, Am. Dyestuff Rept. 71 (1982) 22). The following are particularly preferred:

I: A 40% (% by weight) aqueous dispersion of a perfluoro resin mixture which is composed of 4 parts of a copolymer A and 6 parts of a copolymer B. 70% of copolymer A consists of units of the formula

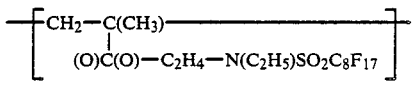

and 30% of copolymer A consists of units of the formula

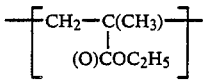

B is a methyl methacrylate/ethyl methacrylate copolymer with a content of methyl methacrylate of about 80%.

II: A 30% (% by weight) aqueous dispersion of a perfluoro resin mixture which is composed of 9 parts of the copolymer A described in I, 6 parts of the copolymer B described in I and 5 parts of a polyurethane C containing perfluoroalkyl groups. The polyurethane C has an average molecular weight of 3,500 and contains the recurrent structural unit

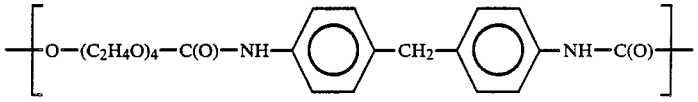

and chain ends of the formula $[C_8F_{17}SO_2N(C_2H_5)C_2H_4—O—]$ or

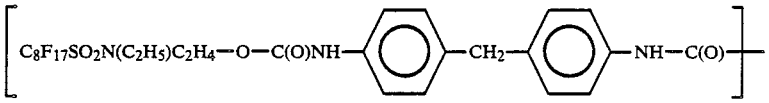

III: A 40% (% by weight) aqueous dispersion of a perfluoro resin mixture which is composed of 2 parts of a copolymer D, 4 parts of a polycondensate E and 4 parts of paraffin. The copolymer D consists of units of the formula

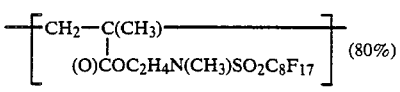

and

-continued

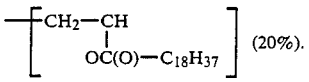

(20%).

E is fomred by the polycondensation of a $C_{20}$ fatty acid mixture with hexamethylolmelamine pentamethylether (1 mol) and methyldiethanolamine (1 mol).

IV: A 40% dispersion of a perfluoro resin mixture consisting of 6 parts of the copolymer A described in example I, 9 parts of the copolymer B described in example I and 5 parts of a perfluorocarboxylic acid ester F. F consists of monomeric units of the formula

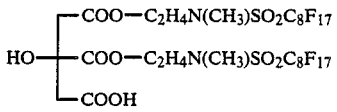

which are linked via polyurethane prepolymers of the formula

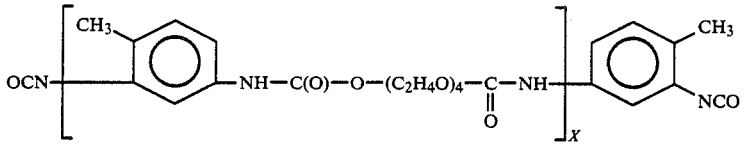

having an average molecular weight of 3000.

V: An approximately 10% dispersion of a perfluoro resin, consisting of a copolymer containing units of the formula

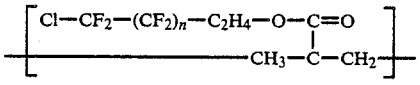

in which n=4, 6, 8, 10, 12 or 14.

The resins which contain $C_4$- or $C_8$-perfluoroalkyl groups are particularly suitable.

In addition to water, it is also possible to add minor amounts of organic solvents to the dispersion in order to obtain particularly favorable properties during application to the fiber.

The finish is effective on any type of fiber, i.e. on fibers made of organically and inorganically based chemical fiber substances and on natural fiber substances.

The treatment agent according to the invention is used in an amount of 0.5–2% by weight, relative to the fiber material.

The finishing products can be applied either before, during or after the textile has been dyed or subjected to further finishing steps, or subsequently, after the textile has been processed into a furniture-covering, upholstery or floor-covering textile, by treatment in the liquor, padding or spraying.

A further method of applying the agent according to the invention to the fiber material involves using the agent together with a cleaning agent, in particular when the textile to be treated was soiled in service or preceding processing steps. The finish is preferably applied to the goods which have up till then not been given a finish by the manufacturer, by spraying the goods with the formulation after they have been wet-cleaned.

The following examples will illustrate the invention in more detail without limiting it.

EXAMPLE 1

A nylon tufting material (loop, 100% nylon) with a pile weight of 300 g/m$^2$ was dyed without drying, was then finished by spraying by means of a one-material spraying unit, was then dried on a stenter at 125° C. in the course of 5 minutes, and was then conditioned at 23° C. and 65% relative humidity for 24 hours. The finishing agent used in this case was:

1: 0.25%, relative to the pile weight of the carpet material, of a 50% aqueous dilution (to which 1% of ethyl acetate had been added) of a fluorocarbon resin according to I 2: 0.75%, relative to the pile weight of the carpet material, of a dilution of a methylsilsesquioxane formulation (as described in Example 2 of U.S. Pat. No. 4,351,736)

3: 1.00%, relative to the pile weight of the carpet material, of the formulation according to the invention (a 1% mixture consisting 0.25% as in 1 and 0.75% as in 2).

Samples were taken from the materials thus pretreated to test the following effects:

(a) Water repellency: single drops of distilled water were applied to the carpet (the diameter of each drop was about 5 mm), and the time the drop took to penetrate into the carpet pile was measured.

(b) Repellency to a water/alcohol mixture: single drops of a mixture of 20 parts of isopropanol and 80 parts of distilled water were applied to the carpet (the diameter of each drop was about 5 mm), and the time the drop took to penetrate into the carpet pile was measured.

(c) Oil repellency (in accordance with AATCC 118-1966). The test sample is placed on a flat horizontal surface, a droplet (droplet diameter about 5 mm) of test liquids 1 to 8 is applied by means of a dropping pipette to various points of the test sample, and, in accordance with the instructions, the result is assessed after 30 seconds in each case. The AATCC oil repellency level of a test fabric is the highest number of that test liquid which does not wet or penetrate the test material within a time span of 30 seconds.

(d) Soil repellency (laboratory soiling test following DIN 54,324; chair caster experiment):

(The chair castor test apparatus consists of a circular turntable with a diameter of 800 mm±5 mm, and a castor mounting which revolves 198 mm±1 outside the center of the test turntable. Three castors are each attached concentrically around the axis of the castor mounting 120° apart, and 130 mm±1 mm from its center, the castors being so attached that they can freely follow the movement of the castor mounting. The area of the test surface area is approx. 0.3 m$^2$, this being determined by the distance separating the two axes, as well as the distance of the castors from the center of rotation of the castor mounting.

The castor mounting can be raised from the turntable, e.g., by means of a spindle when the apparatus is stationary. Each castor is subjected to an evenly distributed mass of 30 kg, giving a total mass of 90 kg.

The turntable and castor mounting form one unit and can change their direction of rotation by means of the appropriate drive gear. The number of revolutions can be pre-set by means of a revolution counter. By maintaining a specified ratio of revolutions of the turntable to revolutions of the castor mounting, the castors describe a trajectory which includes a reversing movement of approx. 160° at a point near the outside edge of the test sample. A vacuum-cleaning device, fitted with height-adjustable nozzles, is mounted over the width of the circular area of the sample to be tested. The vacuum device must have an air suction efficiency of 25–30 liters/second.

The castor mounting bearings should be lubricated regularly with a non-acidic, non-resinous lubricant, and the castors and bearings replaced after approx. 500,000 revolutions of the turntable.

Before starting a new test, the castors should be checked to see that they turn freely. Particles of fiber can accumulate in the bearing and should be removed where necessary (e.g., using compressed air).

Samples were taken from the treated carpet material in accordance with the DIN standards and were soiled with 10 g of synthetic soil of the following composition:

| | |
|---|---|
| 1,932 | g of chamotte |
| 40 | g of black iron oxide |
| 20 | g of yellow iron oxide |
| 8 | g of carbon black |
| 1,000 | g of water |

Following a treatment for 40 hours in a porcelain ball mill, the above mixture is dried, coarse-comminuted, powder-milled and, finally, sieved by means of a sieving machine through a sieve having a mesh width of 100 μm.

The samples are placed under the stress and strain of the chair caster experiment which is described in detail in DIN 54,324, under a total caster load of 60 kg and a change in caster pressure direction after every 50 turns.

The following table shows the results of the tests:

| | (1) | (2) | (3) |
|---|---|---|---|
| (a) Penetration of Water Time (sec) | >180 | 50–80 | >180 |
| (b) Penetration of water/isopropanol Time (sec) | 5–10 | 0 | >180 |
| (c) Penetration of oil Values: 1 to 8 | 5 | 0 | 6 |
| (d) Soil Repellency Values: | 3 | 4 | 4 |

1 = severe soiling
5 = no soiling

EXAMPLE 2

A polyester tufting material (loop, 100% PES) with a pile weight of 400 g/m² was treated as described in Example 1.

| | (1) | (2) | (3) |
|---|---|---|---|
| (a) Penetration of Water Time (sec) | 80–100 | 30–50 | 140–160 |
| (b) Penetration of water/isopropanol Time (sec) | 20–30 | 0 | 80–100 |
| (c) Penetration of oil Values: 1 to 8 | 3 | 0 | 4 |
| (d) Soil Repellency Values: | 4 | 4 | 4 |

1 = severe soiling
5 = no soiling

EXAMPLE 3

An acrylic tufting material (loop, 100% PAC) with a pile weight of 500 g/m² was treated as described in Example 1.

| | (1) | (2) | (3) |
|---|---|---|---|
| (a) Penetration of Water Time (sec) | 80–100 | 30–50 | 140–160 |
| (b) Penetration of water/isopropanol Time (sec) | 20–30 | 0 | 80–100 |
| (c) Penetration of Oil Values: 1 to 8 | 3 | 0 | 4 |
| (d) Soil Repellency Values: | 3 | 4 | 4 |

1 = severe soiling
5 = no soiling

EXAMPLE 4

After being dyed and dried a polyacryl awning fabric (weight per square meter: 280 g) was impregnated in a padding machine. The liquor uptake was 20%. Then the fabric was drird on a stenter for 1.5 minutes at 120° C. and subsequently conditioned for 48 hours at 20°–22° C. and a relative atmospheric humidity of 65%. The finishing agents used for this purpose were:

(1) A textile-impregnating agent containing a colloidal suspension of an organosilsesquioxane consisting of units of the formula $RSiO_{3/2}$ (R=methyl) and of silicic acid with $SiO_2$ units, according to example 1 of the U.S. Pat. No. 4,351,736.
(2) A mixture as described under II.
(3) A mixture of 1 and 2 in a ratio 75:25.
(4) A mixture of 1 and 2 in a ratio 50:50 and
(5) A mixture of 1 and 2 in a ratio of 25:75.

The concentration of the finishing agents used was 10 g/l in all cases. When conditioning had finished samples were taken from the pretreated materials in order to test the effects described in example 1:

(a) water repellency
(b) repellency to a water/alcohol mixture (20% isopropanol/80% water)
(c) oil repellency in accordance with AATCC 118-1966.

The results of the tests are shown in the following table:

| | 1 | 2 | 3 | 4 | 5 |
|---|---|---|---|---|---|
| (a) Penetration of Water time (sec) | 0 | >180 | >180 | >180 | >180 |
| (b) Penetration of water/ isopropanol time (sec) | 0 | >180 | >180 | >180 | >180 |
| (c) Penetration of oil | 0 | 4 | 5 | 5 | 5 |

-continued

| | 1 | 2 | 3 | 4 | 5 |
|---|---|---|---|---|---|
| values: 1 to 8 | | | | | |

EXAMPLE 5

A polyamide tufting material (velour, 100% PA) having a weight per square meter of 700 g was treated as described in example 1.

The following finishing agents were used for this purpose:

(1) As in example 1, U.S. Pat. No. 4,351,736.
(2) A finishing agent as described under V.
(3) A mixture of 1 and 2 in a ratio of 75:25 and
(4) A mixture of 1 and 2 in a ratio 50:50.

Samples were taken from the materials thus pretreated in order to test the following effects, as described in Example 1:

(a) water repellency
(b) repellency to a water/alcohol mixture (20% isopropanol/80% water).
(c) oil repellency in accordance with AATCC 118-1966 and
(d) soil repellency (laboratory soiling test in accordance with DIN 54324, chair caster experiment).

The test results are shown in the following table:

| | 1 | 2 | 3 | 4 |
|---|---|---|---|---|
| (a) Penetration of Water time (sec) | 0 | 180 | 180 | 180 |
| (b) Penetration of water/isopropanol time (sec) | 0 | 180 | 180 | 180 |
| (c) Penetration of oil values: 1 to 8 | 0 | 4 | 6 | 6 |
| (d) Soil Repellency values: | 5 | 4 | 5 | 4 |

1 = severe soiling
5 = no soiling.

We claim:

1. A textile finishing agent comprising:

(a) 50 to 80 parts by weight of an aqueous colloidal suspension containing hydrolysates of
(i) trialkoxysilane ($RSi(OR')_3$ or
(ii) a mixture of trialkoxysilane $RSi(OR')_3$ and tetraalkoxysilane $Si(OR')_4$,
where R is $C_{1-7}$ alkyl or an aryl and where R' is $C_{1-4}$ alkyl and
(b) 20 to 50 parts by weight of an aqueus dispersion comprising 5 to 50 weight % of a perfluoroalkyl group-containing resin, the resin having a fluorine content of 0.2–40% by weight, the resin being selected from the group consisting of a polyacrylate, a polyurethane and a polyester, the perfluoralky groups being of the formula $$-Y-(CFx)_n-CF_2x,$$

wherein
n is 2 to 19,
x is F, Cl, H, or $$-Y-(CF_2)_{m1}-O-(CF_2)_{m1}-CF_3,$$

where Y is selected from the group consisting of $$-O-(CH_2)_n-,\ -\underset{\underset{R'}{|}}{N}-(CH_2)_n-\overset{\overset{R'}{|}}{N}-SO_2-,$$

$$-NH-(CH_2)_n-,\ -O-(CH_2)_n-\overset{\overset{H}{|}}{N}-SO_2-,$$

$$-O-(CH_2)_n-\overset{\overset{R'}{|}}{N}-\underset{\underset{O}{\|}}{C}-,\ -O-(CH_2)_n-\overset{\overset{R'}{|}}{N}-SO_2-,$$

$$-O-(CH_2)_n-\overset{\overset{R'}{|}}{N}-\underset{\underset{O}{\|}}{C}-(CH_2)_{m'}-S-(CH_2)_n-,$$

$$-O-(CH_2)_n-\overset{\overset{H}{|}}{N}-SO_2-(CH_2)_n-,$$

$$-O-(CH_2)_n-\overset{\overset{R'}{|}}{N}-SO_2-(CH_2)_n- \text{ and } -\overset{\overset{R'}{|}}{N}-SO_2-,$$

$m_1+m_2$ is n and
n is 2 to 19.

2. A textile finishing agent according to claim 1, wherein trialkoxysilane is selected from the group consisting of methyltrimethoxysilane, methyltriethoxysilane, methyltriisopropoxysilane, ethyltriemethoxysilane, ethyltriethoxysilane, propyltrimethoxysilane, isobutyltrimethoxysilane, isobutyltriethoxysilane, 2-ethylbutyltriethoxysilane and 2-ethylbutoxytriethoxysilane.

3. A textile finishing agent according to claim 1, wherein said resin has a fluorine content of 1.0 to 20% by weight.

4. A textile finishing agent according to claim 1, wherein (b) is an aqueous dispersion comprising 40 weight % of a resin which is composed of 4 parts of a copolymer A and 6 parts of a copolymer B, 70% of copolymer A comprising units of the formula $$\left[-CH_2-\underset{\underset{O-C(O)-C_2H_4-N(C_2H_5)SO_2C_8F_{17}}{|}}{C(CH_3)}-\right]$$

and 30% of copolymer A comprising units of the formula $$\left[-CH_2-\underset{\underset{(O)\,C-O\,C_2H_5}{|}}{C(CH_3)}-\right]$$

copolymer B being a methyl methacrylate/ethyl methacrylate copolymer with a content of methyl methacrylate of about 80%.

5. A textile finishing agent according to claim 1, wherein (b) is an aqueous dispersion comprising 40 weight % of a resin which is composed of 2 parts of a copolymer D, 4 parts of a polycondensate E and 4 parts of a paraffin, the copolymer D comprising 80% of units of the formula

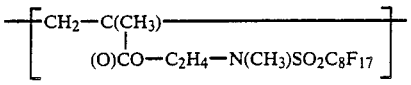

and 20% of units of the formula

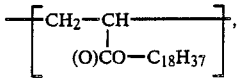

polycondensate E being formed by a polycondensation of a $C_{20}$ fatty acid with hexamethylolmelamine pentamethylether and methyldiethanolamine.

6. A textile finishing agent according to claim 1, wherein (b) is an dispersion comprising 10 weight % of a resin comprising a copolymer containing units of the formula

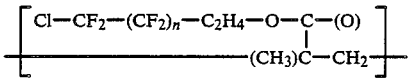

in which n=4, 6, 8, 10, 12 or 14.

7. A textile finishing agent according to claim 1, wherein the resin in (b) contains $C_4$- or $C_8$-perfluoroalkyl groups.

8. A textile finishing agent according to claim 1, wherein said tetraalkoxy silane is tetraethoxysilane.

9. A textile finishing agent according to claim 1, wherein (b) is a 30% weight aqueous dispersion of a perfluoro resin which is composed of 9 parts of a copolymer A, 6 parts of a copolymer B and 5 parts of a polyurethane C containing perfluoroalkyl groups, the polyurethane C having an average molecular weight of 3,500 and containing a recurrent structural unit of the formula

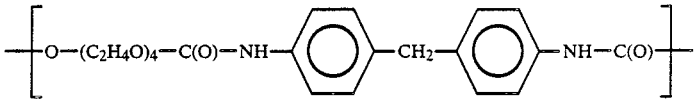

and a chain having ends of the formula $[C_8F_{17}SO_2N(C_2H_5)C_2H_4—O—]$ or

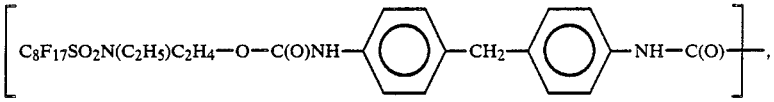

wherein

70% of copolymer A comprises units of the formula

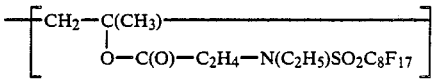

and 30% of copolymer A comprises units of the formula

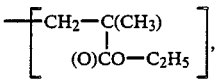

and wherein copolymer B is a methyl methacrylate/ethyl methacrylate copolymer with a methyl methacrylate content of about 80%.

10. A textile material finished with an agent according to claim 1.

* * * * *